US007321723B2

(12) United States Patent
Maran

(10) Patent No.: US 7,321,723 B2
(45) Date of Patent: Jan. 22, 2008

(54) ELECTRIC RADIATOR

(75) Inventor: Ugo Maran, Campodarsego (IT)

(73) Assignee: Emmesteel S.r.l., Campodarsego (IT)

( * ) Notice: Subject to any disclaimer, the term of this patent is extended or adjusted under 35 U.S.C. 154(b) by 16 days.

(21) Appl. No.: 11/219,837

(22) Filed: Sep. 7, 2005

(65) Prior Publication Data

US 2006/0078319 A1 Apr. 13, 2006

(51) Int. Cl.
*F24D 19/02* (2006.01)

(52) U.S. Cl. ..... 392/432; 392/436

(58) Field of Classification Search ..... None
See application file for complete search history.

(56) References Cited

U.S. PATENT DOCUMENTS 4,203,198 A * 5/1980 Hackett et al. ..... 29/611
6,080,974 A * 6/2000 Ambrosiano ..... 219/544
6,483,990 B1 * 11/2002 Bikhovsky ..... 392/458
6,704,497 B2 * 3/2004 Bikhovsky ..... 392/458
2004/0257656 A1 * 12/2004 Sellgren et al. ..... 359/512

FOREIGN PATENT DOCUMENTS

| | | |
|---|---|---|
| EP | 1 030 130 A1 | 8/2000 |
| FR | 2 594 216 A1 | 8/1987 |
| FR | 2 769 166 A | 4/1999 |
| FR | 2 862 374 A | 5/2005 |
| GB | 2 361 990 A | 11/2001 |

* cited by examiner

*Primary Examiner*—Thor Campbell
(74) *Attorney, Agent, or Firm*—Modiano & Associati; Albert Josif; Daniel O'Byrne

(57) ABSTRACT

An electric radiator comprising at least one laminar element, at least one electrified flexible sheet being fixed on the face of said element that is not exposed once installed, the sheet being electrically connectable to an electric power source. Elements for fixing to a supporting structure are associated with the at least one laminar element.

11 Claims, 4 Drawing Sheets

ELECTRIC RADIATOR

The present invention relates to an electric radiator particularly but not exclusively useful as a towel rail or the like.

BACKGROUND OF THE INVENTION

As is known, the domestic radiator market in recent years has become oriented toward styles and models that are extremely innovative with respect to conventional radiators; this orientation arises from the new concept of considering the radiator as a design and interior decoration element.

This new orientation is particularly felt in the field of radiators that act as towel rails.

Said towel rails are often composed of a very small "radiating" part and of a larger "design" part (so to speak), which is heated for example by conduction (consider for example bathroom towel rails formed by uprights in which the heating liquid flows and by "solid" cross-members which are fixed to the uprights and are heated by conduction).

Accordingly, towel rails are not required to generate large amounts of heat.

An interesting trend of the market is to propose radiators and towel rails that have a three-dimensional visual impact, particularly by seeking curved and slender shapes.

Among the various types of radiator that are used, electric radiators are known.

Among the best-known electric radiators, mention should be made of tubular radiators constituted by a series of pipes, which are connected to each other by two hermetic manifolds and inside which an electric resistor is inserted which is connected to the domestic electrical mains.

Glycol liquid is present inside the pipes and conveys heat through the entire radiant body.

Other types of electric radiator are known which are constituted by radiating plates associated with rigid electric resistors.

In both cases, the resistors have a certain thickness and therefore are poorly suited to be used with thin radiant bodies, thus limiting the creativity of designers.

SUMMARY OF THE INVENTION

The aim of the present invention is to provide an electric radiator that can be efficiently shaped so as to have a three-dimensional form.

Within this aim, an object of the present invention is to provide an electric radiator that has a light structure.

Another object of the present invention is to provide an electric radiator that has limited thicknesses.

Another object of the present invention is to provide an electric radiator that can be shaped easily.

Another object of the present invention is to provide an electric radiator that can generate an amount of heat according to the requirements.

Another object of the present invention is to provide an electric radiator that can be manufactured with known systems and technologies.

This aim and these and other objects, which will become better apparent hereinafter, are achieved by an electric radiator, characterized in that it comprises at least one laminar element, on one face of which at least one electrified flexible sheet is fixed which can be connected electrically to an electric power source, means for fixing to a supporting structure being associated with said at least one laminar element.

BRIEF DESCRIPTION OF THE DRAWINGS

Further characteristics and advantages of the invention will become better apparent from the following detailed description of a preferred but not exclusive embodiment thereof, illustrated by way of non-limiting example in the accompanying drawings, wherein.

DESCRIPTION OF THE PREFERRED EMBODIMENTS

Figure 1:
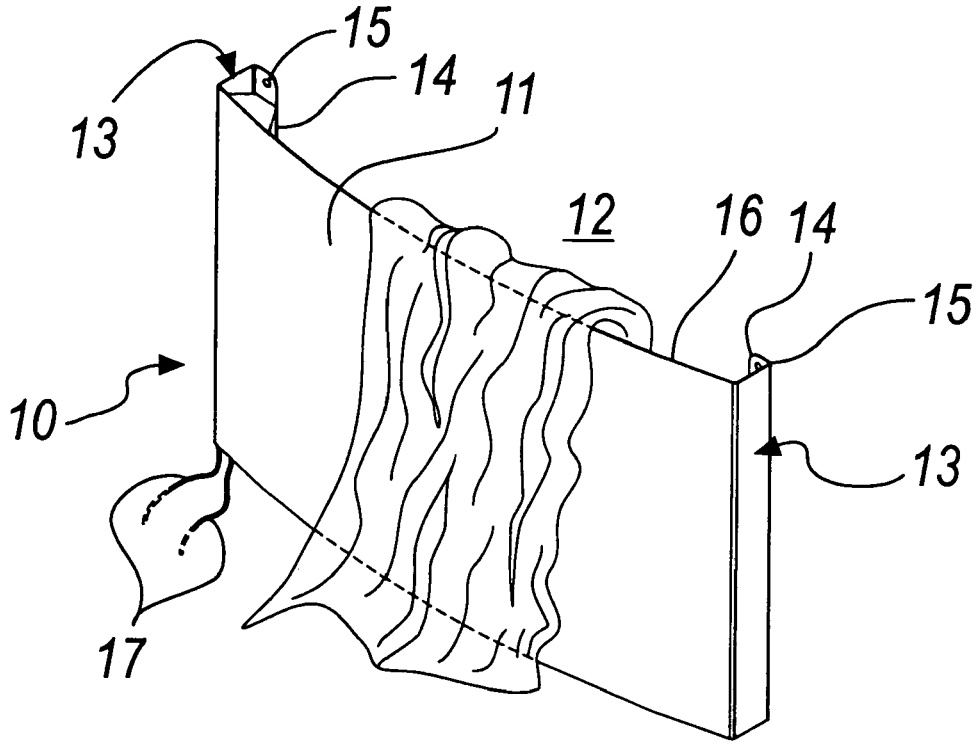
FIG. 1 is an axonometric view of a radiator according to the invention in the form of a towel rail, applied to a wall and with a teacloth placed thereon.
Figure 2:
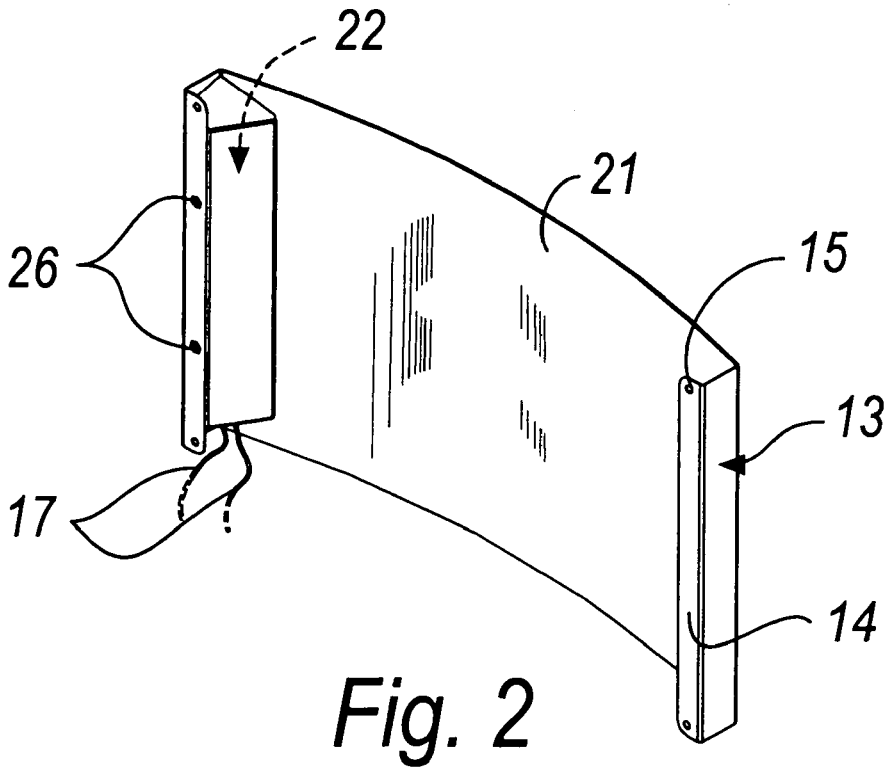
FIG. 2 is an axonometric rear view of the towel rail of FIG. 1.
Figure 3:
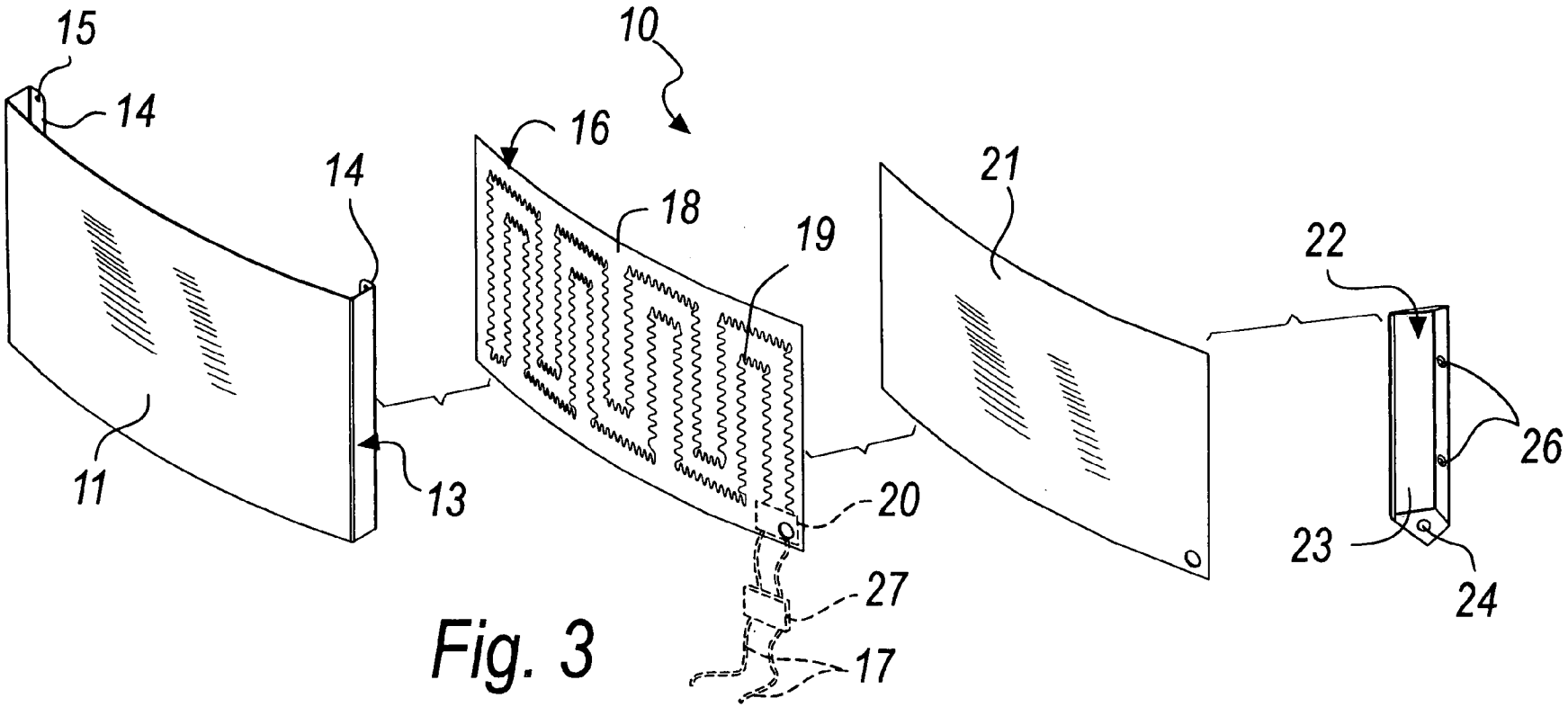
FIG. 3 is an exploded axonometric view of the towel rail of FIGS. 1 and 2.
Figure 4:
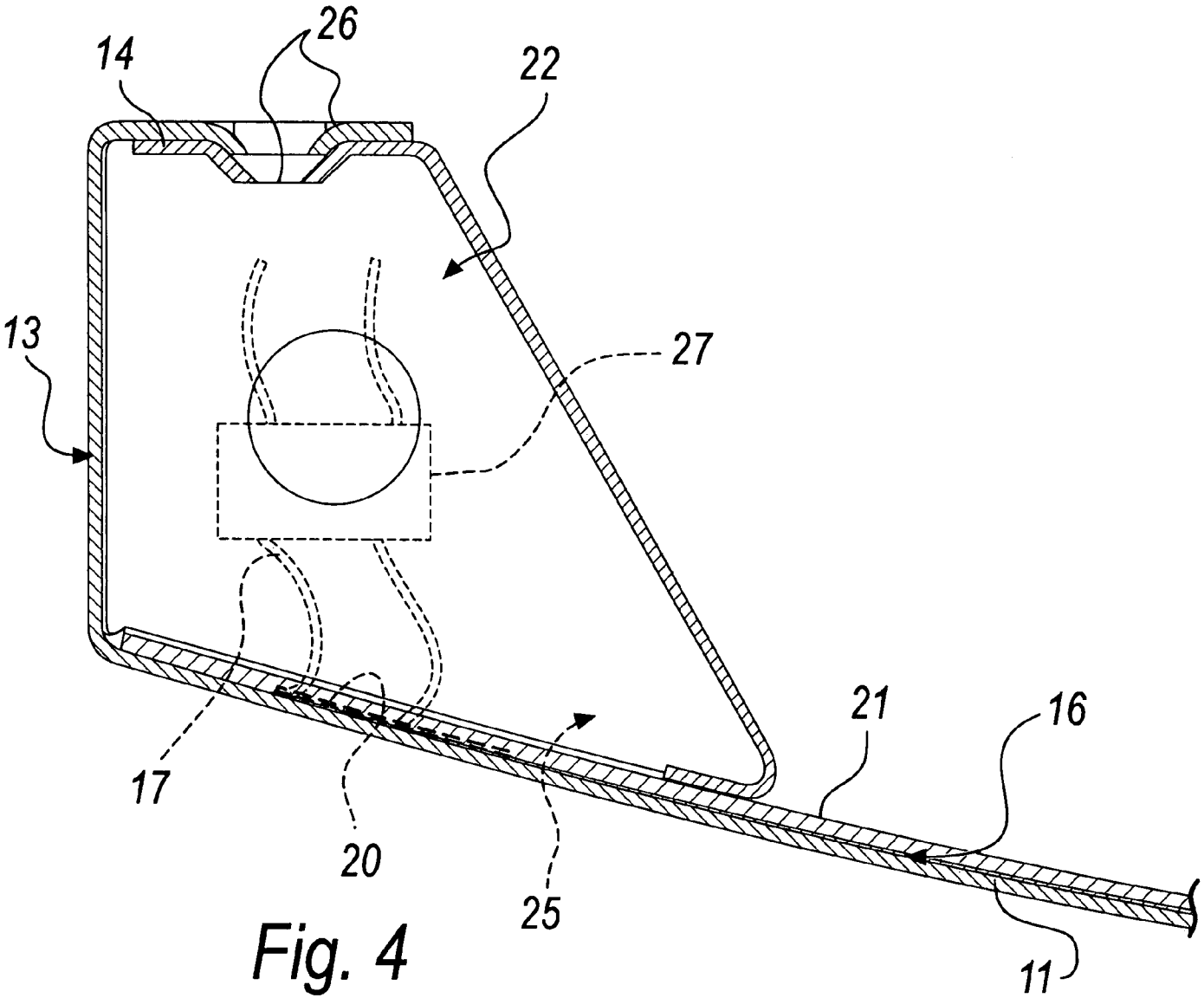
FIG. 4 is a transverse sectional top view of a portion of the towel rail shown in the preceding figures.

With reference to the figures, an electric radiator according to the invention is generally designated by the reference numeral 10.

The electric radiator 10 is constituted by a laminar element 11, which in this embodiment is metallic and has a low thickness, for example 1 mm.

Said metallic laminar element has a substantially rectangular front contour and is substantially convex in the opposite direction with respect to, or away from, the supporting structure to which it is to be applied, such as for example a wall 12.

Fixing to said wall 12 occurs by virtue of fixing means 13, which are constituted for example by C-shaped folds formed on the opposite lateral ends of the laminar element 11.

Said C-shaped folds have corresponding wings 14, on which there are holes 15 for fixing to the wall 12, for example by virtue of screws with expansion plugs (not shown in the figures).

An electrified flexible sheet 16 is provided on the concave side of the laminar element 11, i.e., on the face that is not visible when it is fixed to the wall 12, i.e. is unexposed in installed condition of the radiator. Said electrified flexible sheet 16 can be connected electrically, by way of wires 17, to an electric power source, such as for example the domestic mains.

The electrified flexible sheet 16 is constituted for example by a film 18, on the surface of which an electric resistor 19 is printed which has terminals 20 for connection to the wires 17.

The electrified flexible sheet 16 is fixed for example to the laminar element by virtue of adhesive.

Said film 18 with the printed electric resistor 19 is generally commercially available with a layer of adhesive already integrated on the film 18.

In alternative embodiments, it is possible to use a plurality of electrified flexible sheets arranged side-by-side on the laminar elements and mutually connected so as to form a radiant source of the chosen power and intensity.

To the rear of the electrified flexible sheet 16 there is a lamina 21, which is such as to enclose substantially in a sandwich-like fashion, together with the laminar element 11, the electrified flexible sheet 16.

In this embodiment, the lamina 21 is metallic and is welded at the end to the laminar element 11.

The radiator 10 further comprises a collecting compartment 22 for part of the wiring 17 for the electrical connection of the electrified flexible sheet 16.

The compartment 22 is delimited at one of the two C-shaped folds by means of a shell 23, which is metallic in this embodiment and has an opening 24 for the exit of the wiring 17 toward the electric power source, and likewise has an inlet 25 for said wiring 17 that arrives from the electrified flexible sheet 16.

The shell 23 is fixed to the corresponding wing 14 by means of threaded elements (not shown in the figures), which are engaged through corresponding holes 26 formed in the wing 14 and on the shell 23.

A thermal protection device 27 of a substantially known type is also connected to the wiring 17 and is designed to protect the wiring and the electrified sheet 16 against unexpected thermal overloads.

The compartment for collecting the wiring 17 can also act as a container for other "accessories" (not shown in the Figures) of the radiator, such as for example lights, any transformers, special switches, power outlets, etc.

For example, in some embodiments not shown in the drawings, it is possible to associate with the structure of the radiator an ambient thermostat, which is of course electrically connected to the electric power supply.

This ambient thermostat, optionally connected to a control unit (which in turn can also be connected to other similar radiators), allows to adjust the temperature of the radiator according to the temperature required in the room.

In practice it has been found that the invention thus described solves the intended aim and objects.

The present invention in fact provides an electric radiator that has low thicknesses.

This has been achieved by virtue of the application of electrified flexible sheets to thin laminar elements.

The Joule effect generated by the current that flows through said electrified flexible sheet is such as to produce a heat that is sufficient for the intended use, for example the use as a towel rail and as a space radiator.

The particular thin configuration allows to deform the laminar element according to the invention, making the radiator assume three-dimensional configurations according to the requirements.

The thickness of the laminar element may be various, depending on the requirements, always within the limit of a low thickness, such as to allow the chosen design effect.

For example, the thickness of the laminar element can be comprised between 0.5 mm and 10 mm, also in relation to its "flat" dimensions and to the materials of which it is made.

Materials that are alternative to metallic ones (for these metallic ones, steel) may be for example glassy, ceramic and similar materials.

It is also possible to provide radiators from a plurality of laminar elements with which the electrified flexible sheets are associated, said sheets being wired in series to each other, providing various compositions.

In the particular described embodiment, the radiant element has a total thickness of approximately 2 mm.

The contours of the laminar element may be extremely various, both in terms of dimensions and in terms of shapes, and the means for fixing to the supporting structure may also be various and comply with design requirements.

Figure 5:
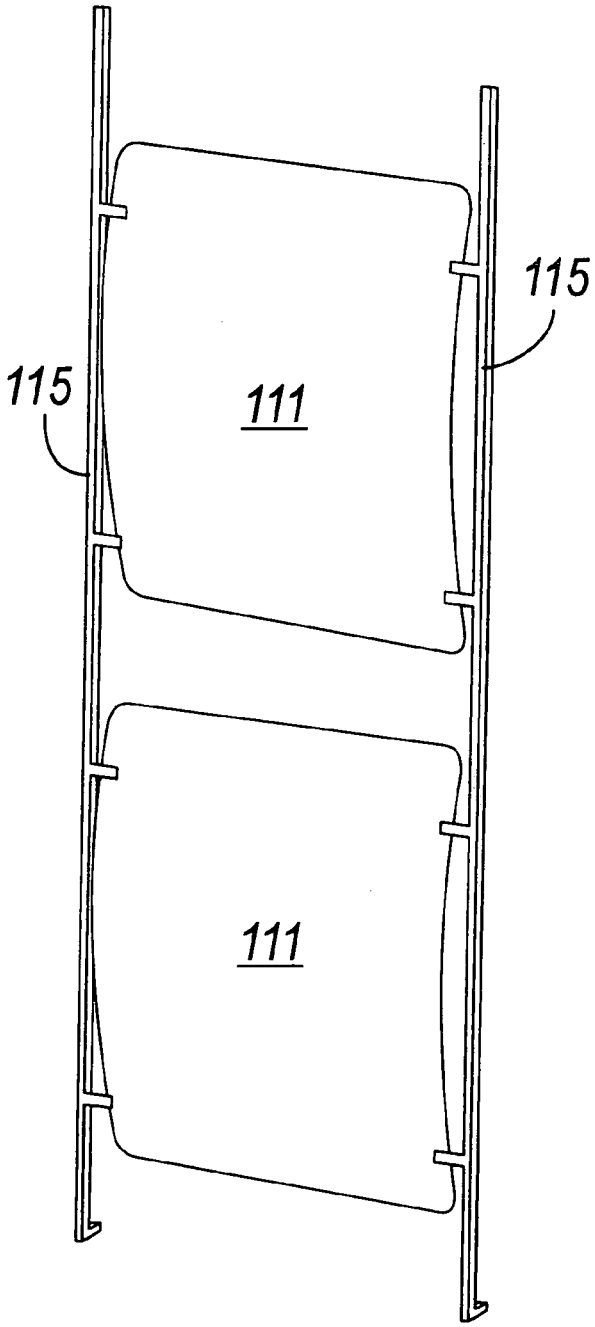
FIGS. 5 and 6 are views of two alternative embodiments of a radiator according to the invention.

For example, one alternative embodiment is shown in FIG. 5. This embodiment shows, for example, two rectangular convex laminar elements 111, which are arranged one above the other and are fixed to a wall by virtue of the lateral supporting uprights 115.

Figure 6:
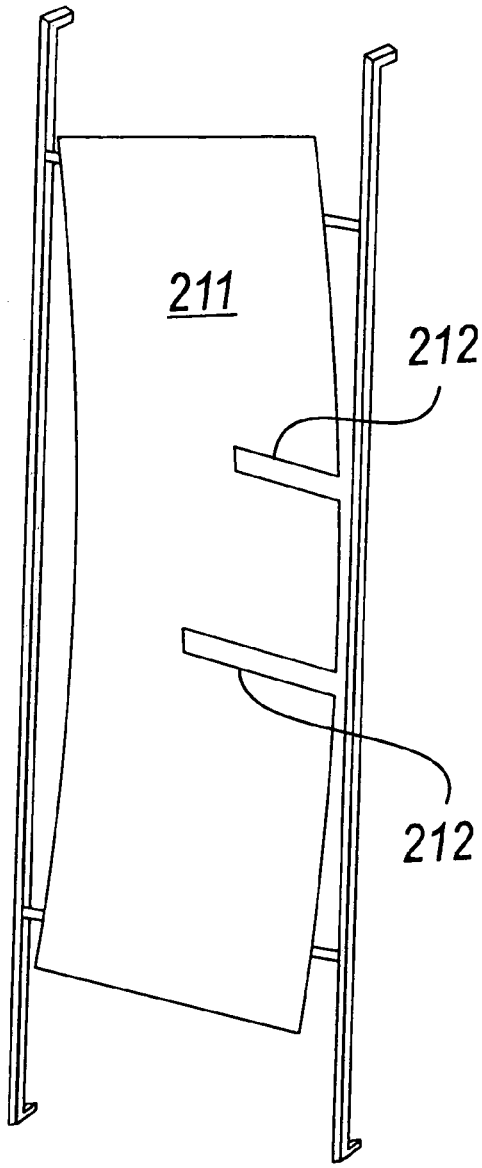

Another embodiment, shown in FIG. 6, shows a single rectangular laminar element 211, which is curved so as to be concave, its exposed surface having transfers notches 212 that have a design character.

Other embodiments, not shown in the figures, can comprise squat shapes, thin three-dimensional shapes, such as for example cubic shapes, cylindrical shapes, etc, all provided by means of thin walls.

It is evident that the heating power of the radiator can be managed on the basis of the associated electrified sheet and on the basis of the amount of current that is applied.

The invention thus conceived is susceptible of numerous modifications and variations, all of which are within the scope of the inventive concept as defined in the appended claims. All the details may furthermore be replaced with other technically equivalent elements.

In practice, the materials used, so long as they are compatible with the specific use, as well as the dimensions, may be any according to the requirements and the state of the art.

The disclosures in Italian Patent Application No. PD2004A000236 from which this application claims priority are incorporated herein by reference.

What is claimed is:

1. An electric radiator, comprising: at least one laminar element; at least one electrified flexible sheet being fixed on a face of said element that is unexposed in installed condition, said sheet being electrically connectable to an electric power source; fixing means for fixing the radiator to a supporting structure, said fixing means being associated with said at least one laminar element; said fixing means comprising C-shaped folds formed on mutually opposite ends of said laminar element, said C-shaped folds having corresponding wings on which holes for fixing to a supporting structure are formed.

2. The electric radiator of claim 1, wherein said electrified flexible sheet comprises a film provided on a surface thereof with an electric resistor.

3. The electric radiator of claim 2, comprising a lamina, which is arranged so as to close said electrified flexible sheet, substantially in a sandwich configuration, together with said at least one laminar element.

4. The electric radiator of claim 1, wherein said laminar element has a shape with a three-dimensional curvature.

5. The electric radiator of claim 1, comprising a collection compartment for collecting wiring for electrical connection of said electrified flexible sheet to an electric power source.

6. The electric radiator of claim 5, wherein said collection compartment is delimited at one of said C-shaped folds by a shell, which is provided with an opening for allowing wiring exit and with a wiring inlet for wiring arriving from said electrified flexible sheet.

7. The electric radiator of claim 6, comprising holes formed in said shell and threaded elements arranged so as to grip through corresponding ones of said holes.

8. The electric radiator of claim 4, wherein said laminar element is convex in a direction away from a supporting structure to which the radiator is to be applied, and has a substantially rectangular front contour.

9. The electric radiator of claim 8, wherein said laminar element has a thickness comprised between 0.5 mm and 10 mm.

10. The electric radiator of claim 1, wherein said laminar element is metallic.

11. The electric radiator of claim 3, wherein said laminar element and said lamina are metallic.

* * * * *